United States Patent [19]

Larson

[11] Patent Number: 4,960,242

[45] Date of Patent: Oct. 2, 1990

[54] ASPHALT DISTRIBUTOR

[75] Inventor: David L. Larson, Plymouth, Minn.

[73] Assignee: Rosco Manufacturing Company, Madison, S. Dak.

[21] Appl. No.: 225,712

[22] Filed: Jul. 28, 1988

[51] Int. Cl.[5] ..... E01C 19/17

[52] U.S. Cl. ..... 239/168; 239/170; 239/536; 239/551; 251/26; 251/63.5

[58] Field of Search ..... 239/169–170, 239/266, 267, 536, 551; 251/26, 63.5; 137/862, 595; 91/415, 32

[56] References Cited

U.S. PATENT DOCUMENTS

| | | | |
|---|---|---|---|
| 2,699,967 | 1/1955 | Edinborough | 239/164 |
| 3,147,925 | 9/1964 | Compton | 239/168 X |
| 3,393,873 | 7/1968 | Larson | 239/583 X |
| 3,838,817 | 10/1974 | Hill | 239/168 X |
| 4,046,060 | 9/1977 | Becker | 91/415 |
| 4,206,569 | 6/1980 | Randolph | 239/170 X |
| 4,274,586 | 6/1981 | Hill | 239/551 X |

FOREIGN PATENT DOCUMENTS

| | | | |
|---|---|---|---|
| 116704 | 8/1984 | European Pat. Off. | 239/551 |
| 2209453 | 9/1973 | Fed. Rep. of Germany | 239/165 |
| 61154 | 5/1968 | German Democratic Rep. | 239/165 |

*Primary Examiner*—Andres Kashnikow
*Attorney, Agent, or Firm*—Kinney & Lange

[57] ABSTRACT

An asphalt distributor has a spray bar assembly that includes at least one extendable and retractable spray bar section for extending the overall width of the spray bar assembly beyond the lateral sides of a vehicle supporting the assembly. The extendable and retractable section includes a manifold tube that carries the asphalt to be sprayed, and which tube is in turn supported on a hydraulic actuator that is used for extending and retracting the associated manifold tube. The manifold tube is provided with a plurality of spray valve assemblies that are operated in a way so that the valves are turned on to permit spraying automatically as the spray bar manifold is extended laterally outwardly, and turn off the spray for the respective valve assembly as the manifold tube is retracted.

18 Claims, 6 Drawing Sheets

ASPHALT DISTRIBUTOR

BACKGROUND OF THE INVENTION

1. Field of the Invention.

The present invention relates to an asphalt distributor having extendable and retractable spray booms.

2. Description of the Prior Art.

In the prior art various asphalt spray booms, and other roadside spray units have been advanced. Folding booms have been used and longitudinally collapsible or telescoping booms have been used for spraying. The state of the prior art in asphalt spraying is represented by devices such as that shown in U.S. Pat. No. 4,315,602, which shows a roadside spray apparatus that permits lateral adjustment of separate booms relative to their supports, and provides for a typical spray control through the use of solenoid valves and the like.

A similar device is shown in U.S. Pat. No. 4,252,274. The spray booms in both of these patents can be pivoted as well as adjusted laterally.

An adjustable boom agricultural spray unit is shown in U.S. Pat. No. 3,514,038, using a sliding or telescoping boom that is operated through a linkage.

An extensible spraying apparatus shown in U.S. Pat. No. 2,965,307, and boom sections used on this apparatus are mounted relative to each other so that they will be extended or retracted on carriages or tracks. U.S. Pat. No. 2,518,952 shows a striping machine that is used for putting on traffic stripes, and which has concentric boom elements that telescope relative to each other to adjust the lateral spray width.

A mechanically operated telescoping boom assembly is shown in a plant spraying machine U.S. Pat. No. 1,024,239. The telescoping booms are operated by gears.

Telescoping support tubes for a plurality of spray heads is shown in U.S. Pat. No. 1,118,091.

Various breakaway joints have also been advanced for spray booms, such as that shown in U.S. Pat. No. 3,147,925.

Telescoping tube supports are also shown in U.S. Pat. No. 2,144,890 and other patents disclose adjustable booms, as well as extending and retracting members that vary the overall width of spraying or dust applying distributors. Such patents are exemplified by the following, which illustrate the general state of the art:

U.S. Pat. Nos. 395,176; 751,612; 869,958; 999,076; 198,014; 260,761; and 933,039.

When dealing with hot asphalt, substantial problems with extendable and retractable booms can be encountered when the asphalt is cooled and becomes thick and additionally the ability to accurately place the spray by insuring that the nozzles are turned on and off as the boom extends is an advantage that makes a difference for satisfactory operation.

SUMMARY OF THE INVENTION

The present invention relates to a spreader for materials on roadways, such as hot asphalt, which has a spray bar assembly made up of three spray bar assemblies. Two of the spray bar assemblies can be extended to increase the lateral width of the spray assembly and retracted to provide for an overall width of less than eight feet, which is within the legal limit for road transport.

The spray bar assemblies include manifold tubes carrying heated asphalt. The manifold tubes have spray valves that can be operated remotely for normal on-off spray valve operations, but the spray valves include an override control so that when the override control is active, the spray valves being controlled will be shut off regardless of the normal operator control. The override control shutoff can be accomplished automatically as the manifold tubes are retracted, so that the valves are shut off as the manifold tubes are retracted. The retractable spray bars, when retracted, are aligned with a stationary spray bar that normally covers the region immediately behind the vehicle carrying the assembly. The spray valves will be turned on automatically as each of the extendable and retractable spray bars are extended toward the respective sides of the vehicle.

The extendable and retractable spray bar assemblies are controlled and supported in a unique manner by utilizing hydraulic actuators that not only control extending and retracting the movable spray bar assemblies but also support the respective movable manifold sections. One end of each manifold section is supported on a sliding bearing that rides along the outer surface of the associated actuator cylinder tube. The other end of the same manifold tube is connected to the rod of the associated hydraulic actuator so that as the rod extends the manifold tube is moved laterally outwardly, while connected to the rod. The opposite end of the manifold tube is guided directly on the cylinders so there isn't any problem with misalignment or the like. As the manifold tube moves outwardly, the spray nozzles are automatically released from the override control so the valves will be turned on. As the manifold tube is moved inwardly, the spray nozzles are closed off by operation of the valve override control.

The individual valves for the spray nozzles also can be operated manually to control which nozzles are expelling materials.

The assembly is reliable, easily operated, and lends itself well to remote operation from a vehicle cab.

Control of extension of the manifold tubes can be provided by having a digital indication for each valve as the extendable spray bar assembly passes a reference point, and in this manner the total overall width of the unit can be controlled and varied as desired.

DETAILED DESCRIPTION OF THE PREFERRED EMBODIMENTS

Figure 1:
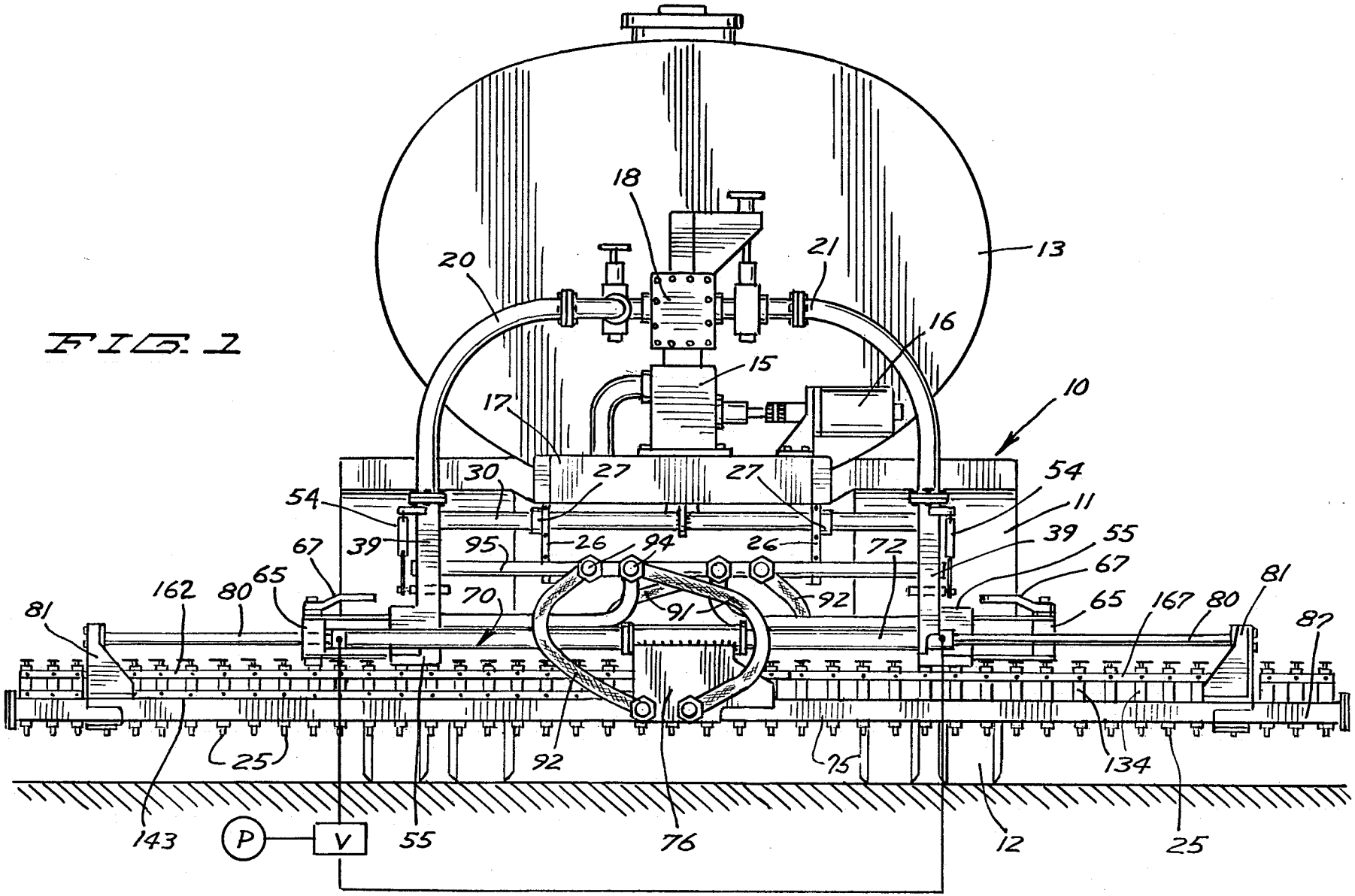
FIG. 1 is a rear elevational view of an asphalt distributor made according to the present invention shown installed on a truck.

An asphalt spreader indicated generally at 10, as shown comprises a vehicle 11, such as a truck that has ground support wheels 12, and which carries an asphalt storage tank 13. The truck is powered from an engine (not shown) which is used to power a hydraulic pump to drive a hydraulic motor 16 which drives a pump 15 for asphalt or other liquid to be sprayed. The pump is mounted onto a frame assembly 17.

The frame assembly 17 comprises a main support for the asphalt pump assembly. The asphalt pump and necessary heaters and the like are conventional arrangements, and the pump is used for providing material to a manifold 18. A pair of distributor hoses 20 and 21 extend from the manifold 18 to carry material to the opposite sides of the spray bar assembly. The hoses 20 and 21 distribute asphalt under pressure to spray bar manifolds that carry the materials such as asphalt to individual spray nozzles indicated generally at 25. Nozzles 25 are supported on the spray bar manifolds at a conventional 4 inch spacing.

Figure 4:
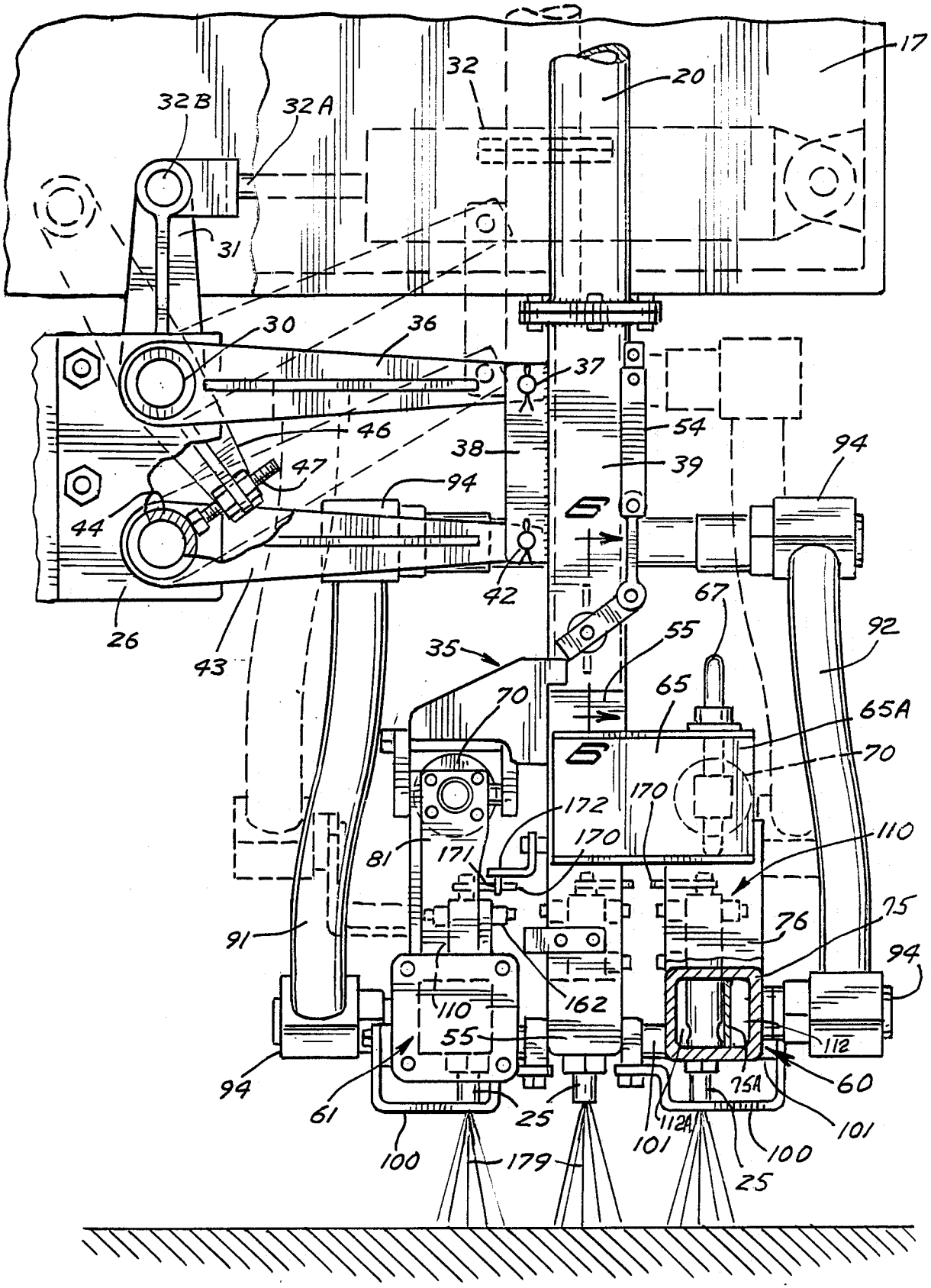
FIG. 4 is an end elevational view of the asphalt distributor of the present invention as viewed from the left end of FIG. 2.

The spray bar assembly is supported from a pair of spaced apart support plates 26,26 adjacent opposite ends thereof. The plates 26 are bolted or fixed to the vehicle frame and form the main support back to the vehicle. A main control tube is rotatably mounted on the plates 26 and is held axially by collars 27 on the outer sides of plate 26. The control tube 30 is made so that it will rotate relative to plates 26 and is used for raising and lowering the spray bars carrying the spray nozzle assemblies. As shown, a control arm 31 is attached to the tube 30, and a hydraulic cylinder 32 connected back to frame 17 is used for moving the arm 31 to rotate the control tube 30 for raising and lowering the spray bar assembly 35 which is supported on support arms 36 that are fixedly mounted to opposite ends of the support tube 30. As can be seen in FIG. 4, the arms 36 have their outer ends pivotally mounted with pins 37 to brackets 38 that are in turn fixedly mounted onto upright, laterally spaced apart sprayer bar frame members 39 forming part of the spray bar assembly 35. The brackets 38 have lower ends with pins 42 that are mounted to outer ends of parallel link arms 43, which in turn are mounted onto a cross pivot shaft 44 that is rotatably supported at the lower ends of the support plates 26.

A stop arm shown at 46 is fixed to the tube 30, and a stop bolt 47 is threaded through the outer end of the stop arm 46 so that the head of the stop bolt 47 will abut against the pivot shaft 44 to provide a positive stop at the lowered (working) position of the distributor assembly 35 when the control arm 31 is in its solid line position shown in FIG. 4.

It can be seen when the actuator 32 is operated to extend its rod 32A, a pin 32B which connects the rod 32A to the arm 31 will then carry the load to rotate the tube 3, and lift the arms 36 and 43 upwardly to the dotted line position shown in FIG. 4, thereby lifting the distributor assembly 35 as well.

Figure 6:
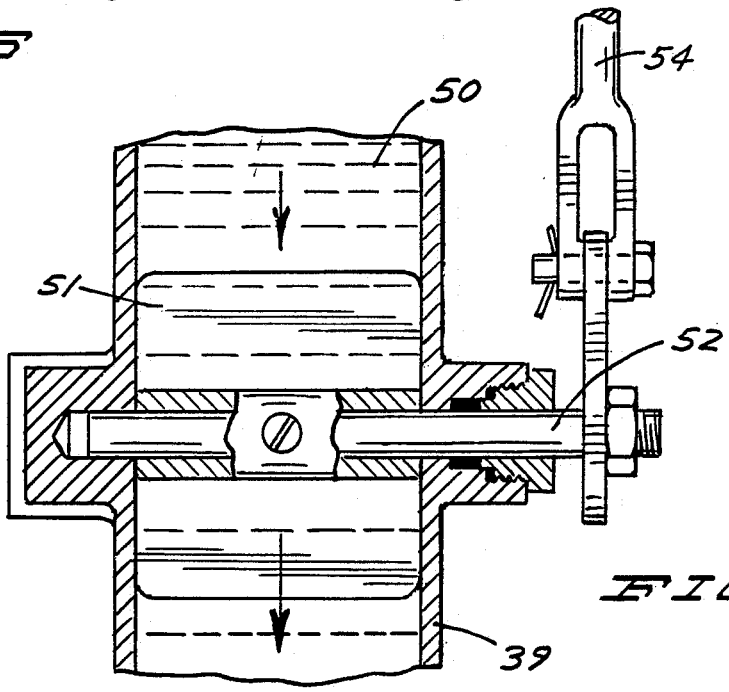
FIG. 6 is a fragmentary sectional view taken as on line 6—6 in FIG. 4.

The spray bar assembly includes the vertical frame portions 39, and suitable cross frame members can be provided to insure stability between the vertical members 39. Frame members 39 also comprise tubular conduits for carrying asphalt. For example, as shown in FIG. 6 the vertical members 39 each have a passageway shown at 50, and a butterfly valve 51 can be mounted on a cross shaft 52 to the conduit frame member 39 and the position of the butterfly valve is controlled by a pneumatic cylinder 54. When closed, the valve 51 causes hot asphalt to circulate through the spray bars when there is no spraying.

The asphalt spray bar assembly 35 comprises three individual sections, that are supported on the frame members 39 and controlled by the arms 36, including two extendable spray bar sections, one of which extends outwardly to each side of the vehicle 11, and a center spray bar assembly 56 which provides for spraying asphalt or other materials in the center portions of the vehicle, behind the wheels 12. The center spray bar section is directly supported on vertical frame members 39 and provides rigidity to help support the extendable spray bar assemblies.

Figure 3:
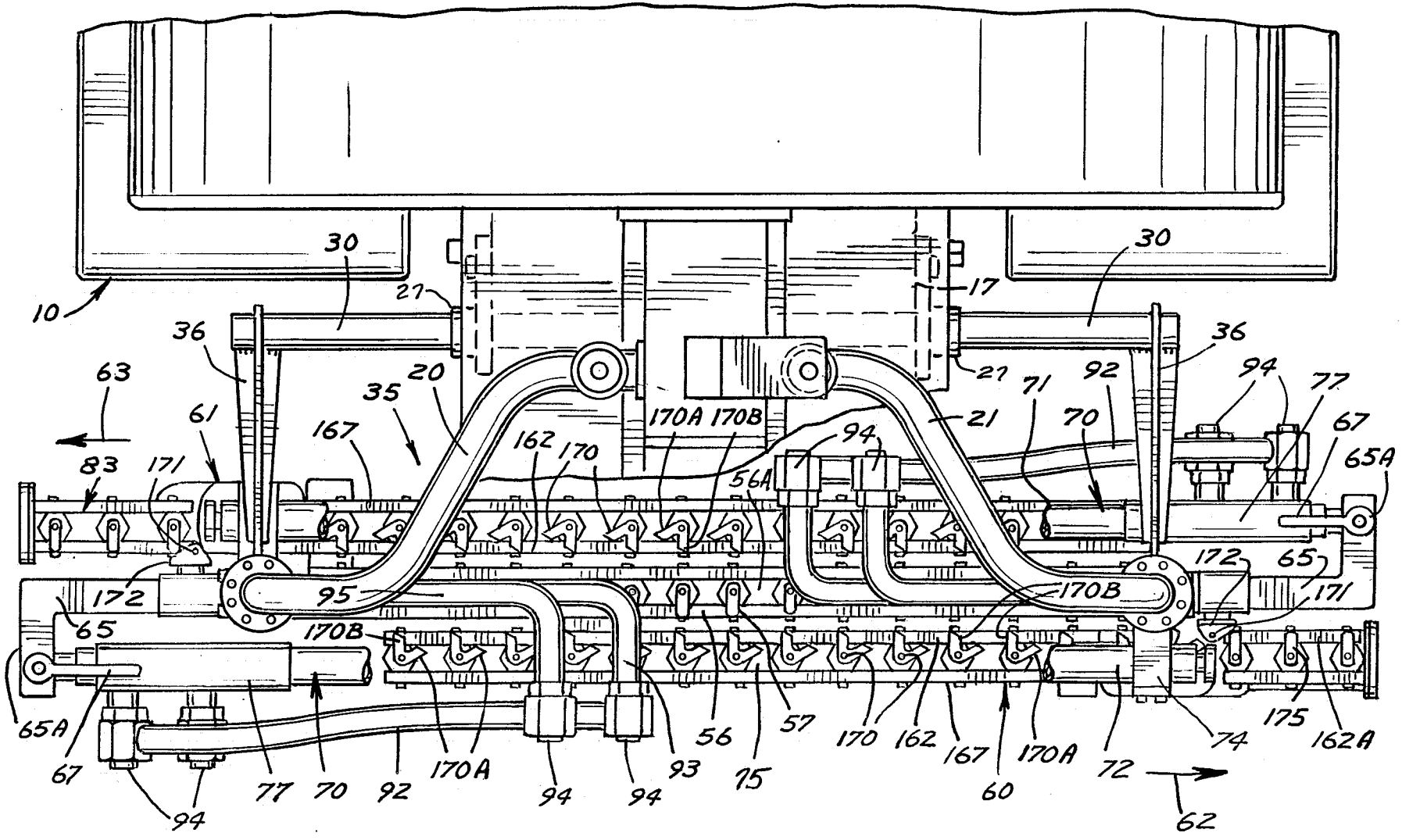
FIG. 3 is a top plan view of the device of FIG. 2.

As can be seen in FIG. 3, the center spray bar assembly 56 is of generally conventional design and extends across the span between the arms 36,36 and is supported in a suitable manner onto the vertical frame members 39, as perhaps can best be seen in FIG. 1. The spray bar assembly has a center spray bar section manifold tube 56A that is connected to frame member 39 through lower end support tubes 55 on each of the frame members 39. The plates 55 are made sufficiently rigid so that they will support the center spray bar manifold tube 56A in position and so that the manifold tube 56A will then be raised and lowered along with the frame members 39 as actuator 32 is operated. The interior conduits of the upright frame members 39 are open to the interior of the manifold tube 56A, so that spray valve assemblies indicated at 57 for the central spray bar assembly can be controlled to provide for applying a spray of asphalt, as will be more fully explained.

The center spray bar assembly 56 is a spray bar that does not extend or move laterally. The extendable spray bar sections are provided at the front and rear of the center spray bar assembly 56. As shown, a rear spray bar assembly 60 and a front spray bar assembly 61 are both made to extend laterally from the vehicle, in opposite directions. The rear spray bar assembly 60 is made to extend in direction indicated by the arrow 62, while the front spray bar assembly 61 extends in direction as indicated by the arrow 63 to position the spray bar assemblies laterally of the vehicle to increase the width of the overall spray bar assembly 35 during working conditions. The front and rear spray bar assemblies can be retracted to an eight foot transport width when they are in the position shown in FIG. 3.

The rear spray bar assembly 60 is supported through suitable brackets with respect to the frame members 39. Hydraulic actuators that have their lengths extending laterally of the vehicle are used to support and control movement of the movable spray bar manifolds and nozzle assemblies. The front and rear spray bar assemblies 60 and 61 are constructed the same, except one is a mirror image of the other. They operate in the same way.

Figure 2:
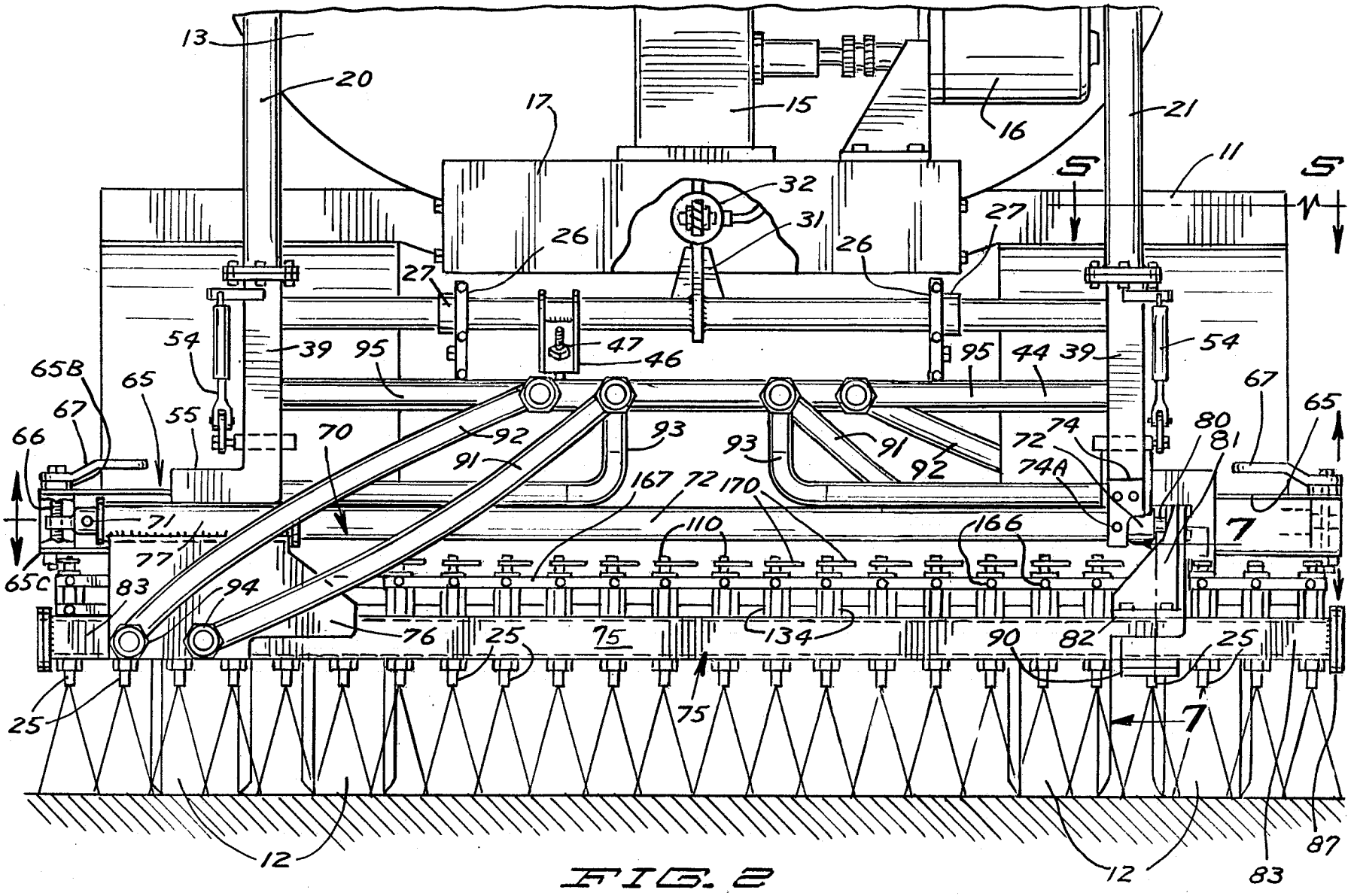
FIG. 2 is an enlarged rear elevational view of the center portions of the device of FIG. 1 with side spray bars retracted.

As can be seen in FIG. 3, as well as in FIGS. 1 and 2, the lower end support portion 55 on the left hand frame member 39 has an "L"-shaped bracket 65 welded thereto which extends to the left as shown in FIG. 2 and which has a rearwardly extending leg 65A. Bracket 65 is a rigid support bracket that is directly supported by the associated frame member 39 and thus by the arms 36 and support tubes. The leg portion 65A is channel-shaped and at its outer end supports a vertically oriented adjustment screw 66. An operating lever 67 is fixed to the screw 66 and is accessible from the top of the bracket. The adjustment screw 66 is rotatably mounted in the legs 65B and 65C of the bracket 65, and is threaded through an end plate or tang 71 fixed to the base end of a hydraulic actuator assembly, which is indicated generally at 70. The plate or tang 71 is fixed to an outer cylinder (tube) 72 of the actuator assembly 70. The base end of actuator assembly 70 then is mounted to the frame members 39 through screw 66 and bracket 65. The base end of the actuator assembly 70 can be adjusted up and down a limited amount along the adjustment screw 66, while being very stably supported from unwanted movements.

The opposite end of the cylinder 72 of the actuator assembly 70 is supported relative to the other frame member 39 at the right hand end of the frame through a support housing 74 that is fixed to the right upright frame member 39 and which extends rearwardly therefrom on the right hand side of the frame. This support housing 74 supports the outer periphery of the cylinder 72 of the actuator assembly 70 through a trunnion. The cylinder 72 is securely supported relative to the respective frame member 39 but can pivot as screw 66 is adjusted. The cylinder 72 is of substantial diameter and provides structural support.

The rear spray bar assembly 60 includes a conduit forming a manifold tube or bar 75 that carries spray nozzle assemblies 25. The individual nozzles are open to interior passageways or chambers in the manifold tube 75, and the manifold tube 75 has a main support housing 76 fixed at one end thereof. The support housing 76 has suitable apertures or openings leading into the interior of the manifold tube. The support housing 76 includes a sleeve 77 that is slidably mounted on suitable bearings over the outer surface of cylinder 72. The outer surface of cylinder 72 is ground to a smooth finish and plated. Linear bearings in the bearing sleeve 77 will permit longitudinal sliding movement of the support housing 76 and the manifold tube 75 along the cylinder 72.

The actuator assembly 70 includes an actuator rod 80 that is actuated by an internal piston (not shown) within the cylinder 72 using valves and a source of pressure in a normal manner. The actuator 70 can be either hydraulically actuated or pneumatically actuated. The rod 80 in turn is mounted in suitable internal bearings at the outer end of the cylinder 72 adjacent the support 74. A support bracket 81 is mounted to the outer end of the actuator rod 80. The support bracket 81 extends downwardly and connects to an intermediate portion of the rear manifold tube 75, as shown at 82.

To the right end of the support bracket 11, there is an outer break away manifold section 83 of the manifold tube 75, which is mounted on a vertical pivot, and is held in place in a suitable manner so that the extreme outer tube section will break away and pivot rearwardly if something strikes the outer end 87 of the break away section as the vehicle is moving forwardly. As can be seen, there are 3 nozzles 25 on the break away tube section 83. The break away section 83 can be retained in place through a shear pin, a friction retainer or other detent member indicated generally at 90.

The manifold tube 75 is divided with a wall 75A (FIG. 4) to form two longitudinal passageways 112 and 112A. These passageways join at the remote end of the manifold tube so there can be circulation of asphalt for reheating when there is no spraying being carried out.

Asphalt is provided in conduit frame member 39 to the passageways 112 and 112A in manifold tube 75 through the use of hose assemblies or lines indicated at 91 and 92, respectively. The hose 91 is connected to a feeder pipe 93 that attaches to the lower portion of the left frame member 39, and is connected to the pipe 93 through a hose swivel assembly 94. The hose 92 is connected with a pipe 95 to the same frame member 39 at a suitable level through a hose swivel 94. Swivels 94 permit the hoses 91 and 92 to pivot about a generally horizontal axis so that when the manifold tube 75 is moved laterally and the bracket 76 slides along the cylinder 72, the hoses 91 and 92 will continue to provide communication from the interior of frame member 39 to the manifold tube 75. The hoses 91 and 92 both supply asphalt to the manifold tubes when spraying occurs and one hose provides asphalt to passageway 112 and the other receives asphalt from passageway 112A for series flow during asphalt recirculation.

The swivels 94 are conventional hose swivels that are spaced at a desired location above the manifold 75, and the tubes 93 and 95 position the swivels out near the center line of the vehicle so that as manifold tube 75 is extended to the right as shown in FIG. 2, the hoses 91 and 92 will pivot on the swivels 94 and will permit the manifold tube 75 to move while maintaining the flow of asphalt to them and also for providing asphalt to the manifold tube 75 when it is extended all the way to the right or to any position in between its retracted and extended positions.

Manifold tube 75 is divided up into a main section, and the break away section 83, which are pivoted together, and can be guided in a suitable manner on flat or linear bearings as desired. For example, brackets indicated at 100 in FIG. 4 can be provided with bearing pads or sliders 101 that bear against the sides of this movable section of the spray bar assembly, and the brackets can be anchored back to the center stationary spray bar section to provide the guiding.

Figure 7:
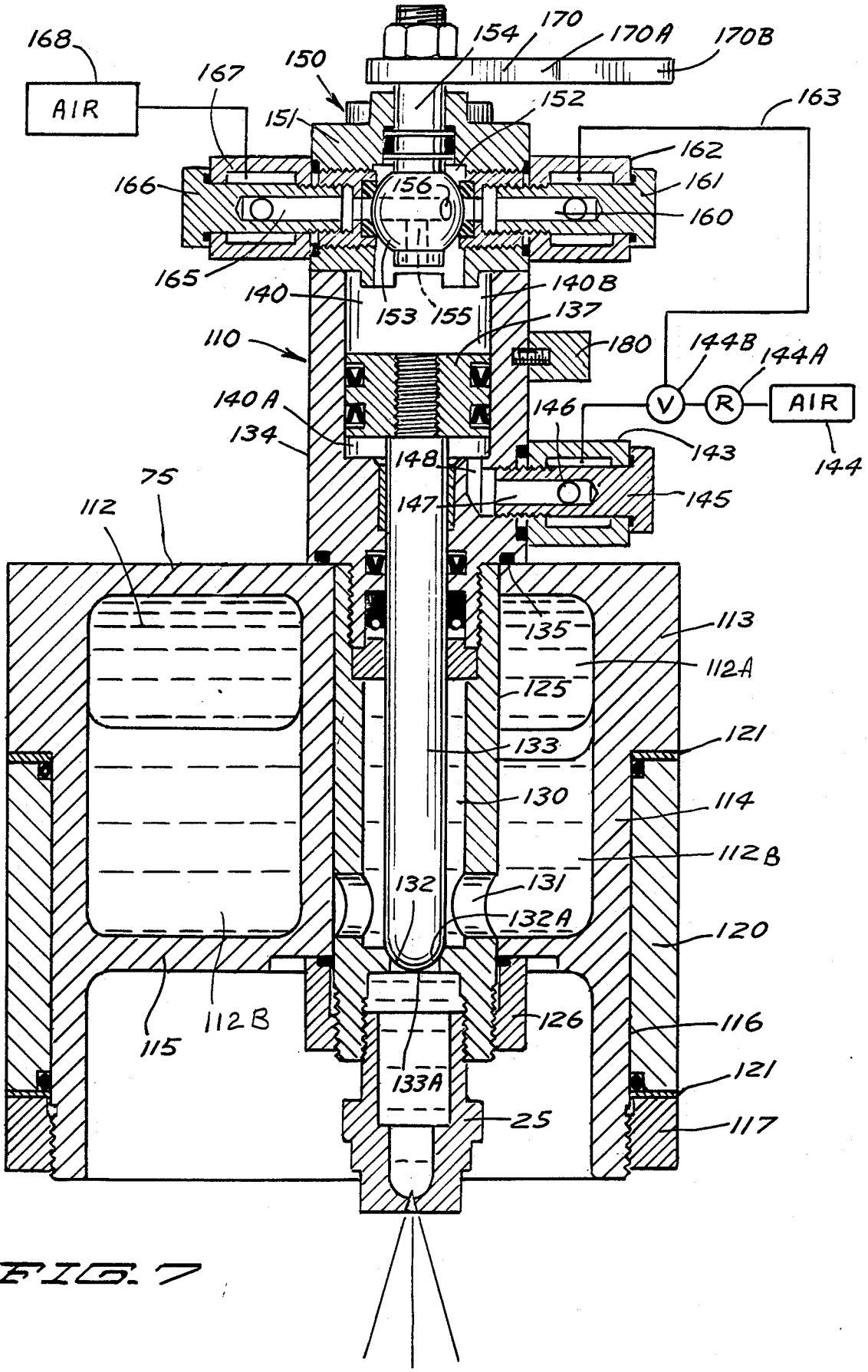
FIG. 7 is a vertical sectional view taken on line 7—7 in FIG. 2 showing a typical control valve portion for an asphalt distributor nozzle made according to the present invention.

The asphalt or other liquid material is sprayed out of each of the spray bar assemblies through a plurality of control nozzles that are typically shown in cross-section in FIG. 7. FIG. 7 is taken through the pivot sleeve or neck for the break away section for spray bar assembly 75, but the main portion of each spray bar assembly is a rectangular manifold tube that has a center passageway to carry the asphalt along its length under pressure provided by the pump. The nozzle and valve assemblies indicated generally at 110 are supported by and extend vertically through the respective manifold tube.

FIG. 7 is taken at the pivot location for the break away section, and thus the cross-section of the manifold tube is somewhat different from the main section but the valves seal and operate in the same manner in the interior chambers of the manifold tube 75.

In FIG. 7, it can be seen that the spray bar forms a rectangular manifold tube that has the two longitudinal interior passageways 112 and 112A that receive the hot (liquid) asphalt, and the interior chambers in FIG. 7 have been formed to have upper portions 113 that forms a depending neck 114 that is cylindrical in shape. Portions 113 are a continuation of the chambers 112, as shown at ll2B. At the outer end of the breakaway section, the passageways 112 and 112A are joined to permit circulation when not spraying. When spraying the passageways 112 and 112A are connected in parallel and both receive asphalt. In the main part of the manifold tube, the chambers 112 and 112A are chambers extending along the entire length of the manifold tube 75. The neck 114 extends down below the bottom wall 115 of the manifold tube 75.

The break away section 83 has a lower neck 120 that surrounds the neck 114, and extends downwardly to surround the skirt portion 116. A nut 117 is then threaded onto the lower end of the skirt portion 116, and is locked in place to hold the neck 120 formed on the break away section 83 in position. The neck 120 is supported on low friction material washers 121, and is suitably sealed, so that it will rotate about the neck 114 and skirt 116. The break away section thus can swing out of the way about the axis of the neck 116 if it strikes an obstruction. The pivot construction is conventional, but a valve assembly 110 is mounted right at the pivot axis, which is unusual.

The break away section 83 can be held in place with a suitable shear pin or break away pin that extends between the main portion of manifold tube 75 of the spray bar assembly and the break away manifold tube portion forming the break away section 83.

There are a plurality of the spray nozzles 25 and associated valve assemblies, and each nozzle is supported at the outlet of a valve assembly 110. In FIG. 7, a typical showing of the operating mechanisms for the valve assemblies 110 are shown. Each valve assembly 110 includes a cylindrical valve body 125 that is of sufficient length to extend vertically through the manifold tube making up the respective spray bar assemblies. The valve body 125 passes through the bottom of the manifold tube 75 as shown in FIG. 7, and is held sealed in the manifold tube with a nut 126 that threads onto the lower end of the valve body 125. Nozzle 25 is threaded into an interior bore in the lower end of the valve body.

The valve body 125 has an interior bore or chamber 130 which is open to the interior chambers 112A of the manifold tube of the respective spray bar assembly in which the valve body is mounted, through one or more apertures 131 adjacent the lower end of the manifold tube.

The communication to the nozzle 25 of each of the valve assemblies 110 is through a bore 132 surrounded by a valve seat 132A on the interior of the valve body. Flow through the valve seat and bore is controlled by a part spherical end surface 133A of a valve rod 133 that is sealably, slidably mounted with respect to a valve head 134 that is threaded into the interior of the valve body 125. The valve head has a shoulder shown at 135 that rests against the upper surface of the manifold tube so that the nut 126 will clamp the valve assembly tightly.

The valve rod 133 is slidably mounted with respect to the head 134 through suitable wipers, seals and bushings, and a piston 137 is attached to the valve rod 133 at its upper end. The piston is mounted within an interior bore or chamber 140 formed in the valve head 134. This forms a piston-cylinder valve or actuator assembly, and the position of the valve rod 133 is controlled by the position of the piston 137 in the cylinder or bore 140.

In order to control the piston position, suitable air manifolds are used for providing fluid under pressure to opposite sides of the piston 137 as desired. As will be explained, each valve assembly can be operated to close by actuating a separate valve even though a common air supply is open to the "valve open" air manifold. As the valve rods 133 lift away from the respective valve seat 132A, bore 132 opens the flow of asphalt under pressure to the spray nozzles and cause the nozzles to spray onto the ground or roadway. In order to provide the control for opening the valves, an elongated air manifold indicated generally at 143 is provided along one side of the valve heads 134 and a corresponding air manifold is used on the same side of valve heads 134 for the break away portions of the front and rear spray bar assemblies. An air manifold 143 is also used for the valves on the stationary center spray bar assembly.

Air from an air source 144 is provided to a regulator 144A which controls the pressure to a four-way two position valve 144B which, when operated to one position, directs air under pressure through a line to the manifold 143. An insert connector 145 is threaded into the associated valve head and passes through the manifold 143 to provide for an opening 146 and passageway 147 that communicates with a passageway 148 in the valve head to the underside of the piston 137 in a chamber 140A. When fluid under pressure is present in the manifold 143, the piston 137 will be forced upwardly to tend to lift the valve rod 133 upwardly to move end surface 133A away from the valve seat and permit asphalt to flow out through the associated nozzles.

By actuating valve 144B to a second position to direct air to a manifold 162 and relieving air pressure in manifold 143, the piston 137 is moved to close the valve bore as the pressure is released in chamber 140A and applied to the top side of the piston in the cylinder section 140B. A ball valve that is indicated generally at 150, which is operated with an external lever for rotating the valve ball is used to control air flow to the top side of the piston 137.

The valve 150 has a valve body 151 that is fixed to the top of the valve head 134, and closes off the cylinder section of chamber 140B. The valve body 151 is provided with an interior valve seat ring 152 that is suitably mounted in place and the valve seat is made to seat a part-spherical valve ball 153. The part-spherical valve ball 153 has openings therein to provide for fluid passageways. There is a central opening or bore 155 that is along the axis of a control shaft 154. The opening or bore opens into the cylinder section or chamber 140B. Also, there are surface orifices or ports indicated at 156, in at least two different positions on the ball valve, so that in one rotational position of the valve one of the ports 156 will communicate with a passageway 160 that is provided in an insert connector 161 which in turn is providing communication to the interior of the second manifold 162 that is connected to valve 144B. Thus, with the valve ball 153 in one position, the valve 144B controls on-off positioning of the valve rod.

A second surface port 156 is provided in valve ball 153 so that in a second position of rotation of the valve stem 154 about its axis, the port 156 will communicate with the passageway 165 that is provided in an insert connector 166 that provides for fluid communication to the interior passageway of a separate air manifold 167. Manifold 167 is connected to an air source 168 that is at a higher pressure than the air provided by valve 144B.

The position of the valve stem 154 can be manually controlled in some instances, but in the valve assemblies that are on the extendable spray bar manifold tubes, a valve lever 170 is provided for drivably mounting each of the valve shafts or stems 154. The valve lever 170 has first and second legs 170A and 170B, and these legs were made so that they are in line with a depending pin 171 (FIG. 5) that is supported in a bracket 172 that in turn is fixed to the center spray bar. There is a separate bracket for each of the respective front and rear sliding spray bar assemblies 60 and 61.

The valve assemblies 110 are made so that even if the air from valve 144B is providing air to the underside of the piston 137, when the valve ball 153 is in an appropriate position to direct air under pressure from the manifold 167 to the top side of the piston 137, the valve shaft or rod 133 will be forced downwardly to close off the valve outlet orifice. Movement of valve ball 153 is done either manually, or automatically, and it will occur automatically to move the valve ball to the position to insure that the valve shaft 133 is closed off when the extendable manifold is retracted to its transport position by retracting the respective actuator assembly 70.

The principle of operation for closing off the valve rod 133 involves the fact that the piston 134 has a larger area on its top side than on its bottom side, because of the positioning of the valve shaft 133 on the bottom side of the piston. Thus, even if air under pressure is present in the lower chamber portion 140A, when the valve ball 153 is turned to the proper position to shut off any flow from the manifold 162, and permit air under pressure from the source 168 to be provided through manifold 167 to the upper chamber 140B, the piston 134 will be forced downwardly to close off the opening 132 by seating the surface 133A on the valve seat 132A. The pressure in manifold 143 can be regulated to be lower than the pressure in manifold 167, but even with equal pressure in the manifold the piston 134 will be forced downwardly to cause the piston shaft to close off flow of asphalt through the respective nozzle 25 when the valve ball 153 is rotated to the proper position.

When the valve ball is in position so that the manifold 167 is no longer open to the chamber 140B, the valve ball will be in a position to open passageway 160 and manifold 162 to the chamber 140B, and then the operation of the piston 137 and the valve shaft 133 will be controlled by actuation of the valve 144B.

Figure 5:
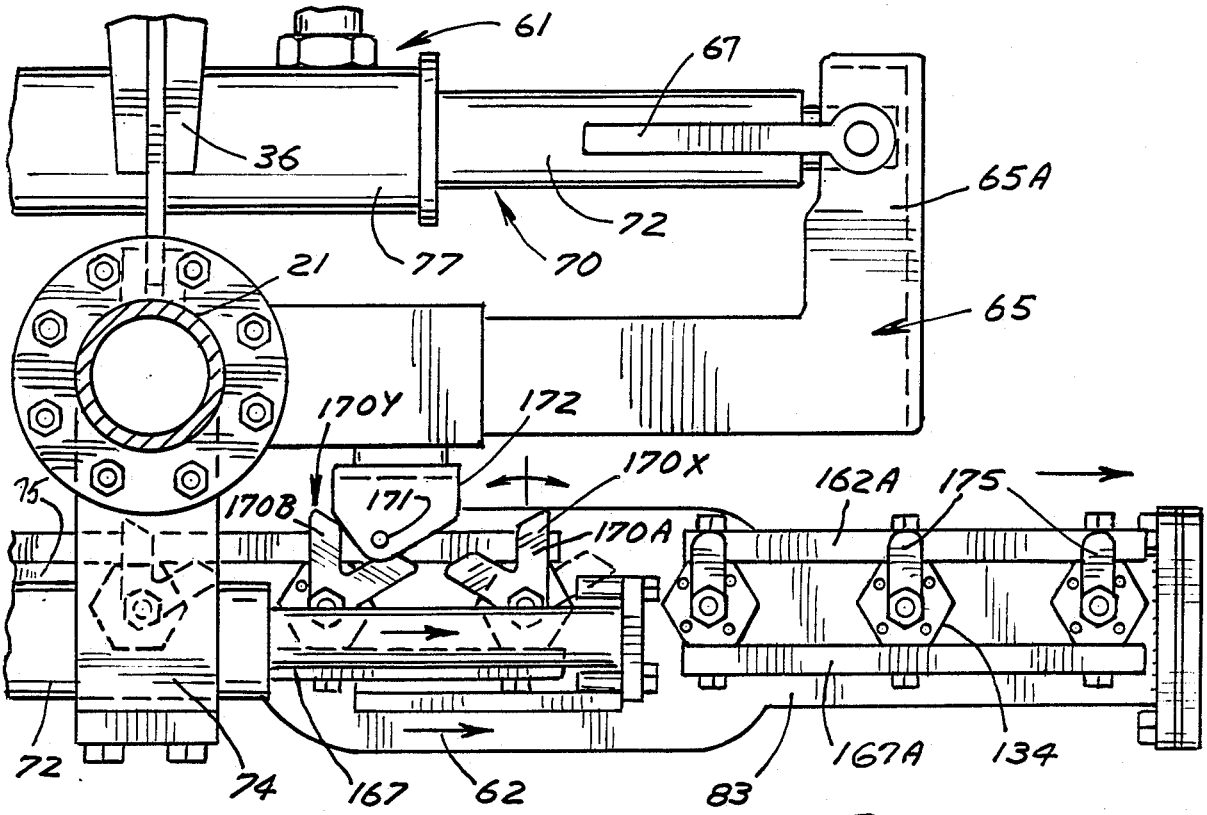
FIG. 5 is a fragmentary top plan view of a valve operating section of the extendable spray bar assemblies of the present invention taken as on line 5—5 in FIG. 2.

The valve actuator levers, and the operation thereof can be shown with reference to FIG. 5.

Two of the valve levers 170 are shown in FIG. 5, and are labeled 170X and 170Y. The valve lever 170X is in a position so that the manifold 167 is closed off from the operation of the piston of that particular valve, but the valve lever 170Y would be in a position so that the manifold 167 would be open to the interior of that valve and the piston 137 would be moved to cause valve shaft to close the valves regardless of the position of the valve 144B.

As the manifold tube 75 was being moved outwardly as indicated by the arrow 62, the pin 171 would engage the leg 170B of the lever assembly 170Y and rotate the lever approximately 60° as the manifold tube 75 moved outwardly, to close off the manifold 167 from operating the piston. In the position of lever 170X, the legs 170B will clear the pin 171.

If the main manifold tube 75 is being retracted inwardly, in its position shown in FIG. 5, the pin 171 will engage the leg 170A of the lever assembly 170X and move it to position to open manifold 167 to the interior of that particular valve to load piston 137 so that there will be automatic operation and automatic shutting off of the valves as the spray bar manifold tube 75 is retracted. The valves will automatically be disengaged from the manifold 167 and subjected to the operation of the valve 144B through either the manifold 143 or the manifold 162 as the spray bar manifold tube 75 is extended outwardly. The valves are then controlled by the operator using valve 144B, which could be remotely controlled from a cab of a vehicle. The flow of asphalt from the manifold tube 75 and through the respective nozzles 25 will be to discharge it in a spray as shown at 179. Again, two positions of the levers are illustrated in FIG. 5, where the lever indicated at 170X has been tripped to move valve ball 153 to position to disable airflow from manifold 167 as the spray bar assembly is moved outwardly as indicated by the arrow 62. The lever 170Y is still in its position wherein the valve shaft 133 has closed off flow of asphalt because the override control flow from valve ball 153 is about to engage the pin 171 shown on the bracket 172 therein.

It should be noted that the center bar valve assemblies for the spray nozzles and the break away portions have manual levers 175 thereon, and these can be manually turned to control the associated spray control valves. Some valves can intentionally be shut off at all times, and of course the levers 170 can be moved manually to close off valves on the fully extended manifold.

Also, it can be seen that when the spray bars are retracted, in FIG. 5, the pin 171 will connect with the leg 170A of the actuating lever 170X and will move it back to its position which closes off asphalt flow at that valve and moves the valve rod 133 down against the valve seat 132A.

The rear spray bar assembly 60 and the front spray bar assembly 61 are mirror images of each other, and the numbers used are the same for the two, and the only difference is that one will slide to the right and one will slide to the left, as shown in FIG. 3. The action of the controls for turning on and off the individual spray valves using levers 170 as the spray bar assemblies are extended and retracted under control of the respective support hydraulic actuators 70 is identical. Also, the hose swivels 94 for the front spray bar assembly extend forwardly from the center spray bar, but operate in the same manner so that the connection hoses will swing as the spray bar assemblies are extended.

Leveling adjustments can be made by turning the handle 67 for leveling purposes of the respective spray bar assemblies. When the horizontal actuators for the spray bar assemblies are actuated, fluid under pressure is introduced into the interior of the cylinder 72 (operation can be selective for either the front or the rear spray bar assembly), the rods will extend and will guide the outer end of the respective spray bar assembly. As the manifold tube 75 is extended, the housing 77 will slide on suitable bushings on the outer surface of the cylinder 72, which is supported by bracket 74 at one end and the screw 66 at the other end. The distance of travel of the spray bar manifold can be controlled, and a digital indication can be provided by having a magnet indicated at 180 on each of the valve heads, so that the magnet would pass by a pickup of desired configuration to provide an impulse as each of the valves passed outwardly beyond a reference point. The magnets can provide a digital input to indicate how many of the spray nozzles are in a working position, so that the operator can control that as desired.

The center spray bar assembly comprises a rectangular manifold tube 56A, that is stationary and part of the support weldment, and the individual valve assemblies 57 which are the same as valve assemblies 110 are mounted in manifold tube 56A in the same manner as shown for the movable manifolds. The control levers for the valves in the center spray bar are manually operated to turn them on and off as desired. Circulation of asphalt also is provided in manifold tube 56A, as is known in the art.

A master control valve can be used for shutting off all of the spray nozzles in the center spray bar section if desired or they can also be controlled with valves 144B. A separate one valve 144B is normally used for all valve assemblies on the respective manifold bars 75, and for the center spray bar one valve 144B will be used for each one foot section of the manifold tube so an operator can vary the spray pattern of the center section in one foot segments.

Vertical adjustment of the entire unit can be made by adjusting the screw 47 on the stop arm 46, and as can be seen in FIG. 2, the stop arm can have a variety of holes in a plate section 46A to provide for different locations to stop for precisely locating the individual nozzles above the ground surface.

Although the present invention has been described with reference to preferred embodiments, workers skilled in the art will recognize that changes may be made in form and detail without departing from the spirit and scope of the invention.

What is claimed is:

1. Apparatus adapted for spraying materials from a moving vehicle comprising:

a frame having means for mounting it onto a vehicle, said frame being positioned to extend generally transverse to the direction of travel of a vehicle mounting the apparatus;

at least one movable spray bar assembly mounted on said frame comprising a manifold tube having a longitudinal axis extending generally transverse to the direction of travel of such vehicle, said manifold tube having a plurality of nozzles therein for carrying material to be sprayed from the manifold tube out through the nozzles;

a fluid pressure actuator for mounting and moving said movable spray bar in longitudinal direction of the manifold tube, said fluid pressure actuator having a cylinder member and an extendable and retractable rod member mounted relative to the cylinder member;

means to fixedly mount said cylinder member to said frame at a desired location;

means to slidably support a first end of said movable spray bar assembly on the exterior of the cylinder member for movement in direction along the cylinder member relative to the frame; and means to couple a second end of the manifold tube to the rod member of the fluid pressure actuator whereby operation of the fluid pressure actuator will cause the manifold tube to be extended or retracted in direction along its longitudinal axis while substantially supported only by the fluid pressure actuator.

2. The apparatus as specified in claim 1 wherein said means to mount the one end of said manifold tube to said cylinder member comprises a sleeve housing slidably mounted on said cylinder member for longitudinal movement along said cylinder member as the actuator rod is extended and retracted.

3. The apparatus as specified in claim 1 wherein said nozzles include actuable valves for controlling flow of the material to be distributed to each of the individual nozzles, each of said valves including means for controlling the valve for movement to open and closed positions, and having first operating means for urging said valves to an open position in response to a first control, and separate second means for urging said valves to a second closed position, said second means being selectively operable to urge an associated valve to a closed position regardless of whether the first operating means are operable or not.

4. The apparatus as specified in claim 3 wherein said means for controlling comprises a valve actuator rod, a piston member coupled to the valve actuator rod, said rod having an end surface cooperating with a valve seat for closing off flow when the end surface of the rod is seated on the valve seat, the piston member being mounted in a valve cylinder, said first operating means providing fluid under pressure to a first side of said piston member to tend to move the rod away from the valve seat, and said second means providing a fluid under pressure to the opposite side of the piston member to generate a force sufficient to overcome the fluid pressure provided by the first fluid under pressure.

5. The apparatus as specified in claim 4 wherein said rod is connected to said piston member on the first side of the piston to provide a differential area between the first and second sides of the piston member.

6. The apparatus as specified in claim 1 and means on said frame cooperating with a vehicle mounting the apparatus for raising and lowering the frame relative to such vehicle.

7. The apparatus as specified in claim 6 and stop means for controlling the lowered position of said frame.

8. The apparatus of claim 1 wherein the apparatus includes a center spray bar assembly attached to said frame and being fixed from movement in lateral direction of a vehicle mounting the frame and first and second movable spray bar assemblies as defined in claim 1 mounted ahead of and to the rear of the center spray bar assembly, and extendable in opposite directions from a vehicle mounting the apparatus.

9. A spray bar assembly having a supply conduit forming a manifold, and a plurality of valves that are operated to provide a spray of material from the conduit at each of the valves, each of said valves comprising a valve body, means for providing a material flow path between the valve body and said conduit, an outlet orifice from said valve body, said outlet orifice defining a valve seat, and a valve member cooperating with said valve seat, and being movable toward and away from said valve seat for controlling flow of material from said manifold through said orifice and said spray nozzle, first means for operating said valve member to a position spaced from said valve seat to permit material flow through said nozzle, second means for providing a force tending to close said valve member toward said valve seat, said second means generating sufficient force to cause said valve member to close regardless of operation of said first means.

10. The apparatus as specified in claim 9 wherein said valve member comprises a piston actuated member, said first means providing a fluid pressure to a first side of said piston to move said valve member away from said valve seat and the second means providing fluid pressure to a second opposite side of said piston to generate a force to cause said valve member to close against said valve seat.

11. The apparatus as specified in claim 10 and third means for providing a fluid under pressure signal to the second opposite side of said piston independently of said second means, said first and third means being commonly controlled from a fluid control valve.

12. The apparatus as specified in claim 9, said second means including a second valve member for controlling fluid under pressure to the second side of said piston, said second valve member having an operating element, and said operating element being external of said first-mentioned valve member.

13. For use in a spray bar assembly comprising a manifold tube carrying material under pressure to be discharged from nozzles, the improvement comprising a controllable valve for each nozzle including a valve body extending through the manifold tube and being sealed relative to the walls of the manifold tube to provide opposite first and second end portions extending from the manifold tube, a nozzle connected to the second end portion on the exterior of the manifold tube, the valve body having a wall defining a central opening, an inlet opening in the wall of the valve body leading from the interior of the manifold tube to the central opening, an orifice between the central opening and the nozzle, said orifice being surrounded by a valve seat, a valve control member carrying a piston and a valve rod connected together, the piston being mounted in a bore defined in a cylinder section of the valve body adjacent the first end portion and the valve rod extending to position adjacent the valve seat, said piston being actuable to move the connected valve rod relative to the valve seat to selectively close the orifice and to open the orifice to permit flow out of the nozzle, and fluid pressure control means on the first end portion on the exterior of the manifold tube for controlling the position of the piston and connected valve rod, the fluid pressure control means comprising first and second passageways open to opposite sides of the piston, and a common valve to direct fluid under pressure selectively to the first and second passageways to control movement of the piston and connected valve rod to selectively open and close the orifice.

14. The improvement of claim 13 wherein the fluid pressure control means further includes an override control valve operable to direct fluid under pressure to a side of the piston to force the piston and valve rod toward the valve seat to close the orifice and to overcome force from the fluid under pressure provided by the common valve tending to move the valve rod away from the valve seat to open the orifice.

15. The apparatus of claim 14 wherein said override control valve comprises a ball valve operable to close the passageway from the common valve to the one side of the piston and simultaneously open a passageway from a separate source of fluid under pressure to such one side of th piston.

16. Apparatus adapted for spraying materials from a moving vehicle comprising:

a frame having means for mounting it onto a vehicle, said frame being positioned to extend generally transverse to the direction of travel of a vehicle mounting the apparatus;

at least one movable spray bar assembly mounted on said frame comprising a manifold tube having a longitudinal axis extending generally transverse to the direction of travel of such vehicle, said manifold tube having a plurality of nozzles thereon, and having a divider therein forming two longitudinal passageways therein for carrying material to be sprayed from the manifold tube through the nozzles, a separate valve for controlling spray of material from each nozzle, each valve having a valve housing on the interior of the manifold tube;

an actuator for moving said movable spray bar in longitudinal direction of the manifold tube;

said movable spray bar assembly including a main section of manifold tube and a breakaway section of manifold tube, and means for mounting the breakway section to the main section at an outer end of the main section comprising a housing forming a cylindrical neck having an interior chamber open to both passageways of the manifold tube, the breakaway section having a sleeve which mounts on the neck for rotation, and a pivot region valve and spray nozzle substantially centered in the neck to control flow from the interior chamber of the neck through the pivot region spray nozzle while permitting pivotal mounting of the breakaway section.

17. Apparatus adapted for spraying materials from a moving vehicle comprising:

a frame having means for mounting it onto a vehicle, said frame being positioned to extend generally transverse to the direction of travel of a vehicle mounting the apparatus;

at least one movable spray bar assembly mounted on said frame comprising a manifold tube having a longitudinal axis extending generally transverse to the direction of travel of such vehicle, said manifold tube having a plurality of nozzles therein for carrying material to be sprayed from the manifold tube out through the nozzles, said nozzles each having an actuable valve for controlling flow of the material to be distributed from the individual nozzle;

first means for controlling the individual valves for movement to open and closed positions movable with the valves as the manifold tube is moved longitudinally; and second means on the frame positioned to sense movement of the first means as the manifold tube is moved between its extended and retracted positions and causing the first means to open each valve when the manifold tube is moving to an extended position and to close each valve as the manifold tube is being retracted as the respective valves move past a reference position.

18. The apparatus as specified in claim 17 wherein the first means comprises a handle on each of said actuable valves, said handles being movable with the manifold tube as the manifold tube is extended and retracted, and the second means comprises a member positioned to engage said handles to operate the handles to cause the associated valves to be closed as the manifold tube is retracted from an extended position.

* * * * *

UNITED STATES PATENT AND TRADEMARK OFFICE

CERTIFICATE OF CORRECTION

PATENT NO. : 4,960,242

DATED : October 2, 1990

INVENTOR(S) : David L. Larson

It is certified that error appears in the above-identified patent and that said Letters Patent is hereby corrected as shown below:

Col. 12, line 18, after "piston", insert --member--.

Col. 13, line 48, delete "th", insert --the--.

Signed and Sealed this

Third Day of March, 1992

*Attest:*

HARRY F. MANBECK, JR.

*Attesting Officer*

*Commissioner of Patents and Trademarks*